United States Patent [19]

Smith

[11] 4,104,019

[45] Aug. 1, 1978

[54] FIXATION OF DYES AND OTHER CHEMICALS IN TEXTILE FIBRES

[75] Inventor: Geoffrey Allan Smith, Melrose, Scotland

[73] Assignee: Dawson International Limited, Edinburgh, Scotland

[21] Appl. No.: 687,602

[22] Filed: May 18, 1976

[30] Foreign Application Priority Data

May 21, 1975 [GB] United Kingdom ..... 21924/75

[51] Int. Cl.[2] ..... D06P 5/20

[52] U.S. Cl. ..... 8/2; 427/45

[58] Field of Search ..... 8/2; 68/DIG. 1; 427/45

[56] References Cited

U.S. PATENT DOCUMENTS

| | | | |
|---|---|---|---|
| 2,366,347 | 1/1945 | Millson | 8/2 |
| 2,460,206 | 1/1949 | Wentz | 68/DIG. 1 |
| 3,572,286 | 3/1971 | Forney | 427/45 |
| 3,579,372 | 5/1971 | Healy | 427/45 |

FOREIGN PATENT DOCUMENTS

| | | | |
|---|---|---|---|
| 727,594 | 2/1966 | Canada | 8/2 |
| 1,344,538 | 11/1962 | France | 8/2 |
| 1,022,651 | 3/1966 | United Kingdom | 8/2 |

*Primary Examiner*—Donald Levy

*Attorney, Agent, or Firm*—Haseltine, Lake & Waters

[57] ABSTRACT

For the fixation of dyes and other chemicals in textile fibres, however formed or combined, such fibres are conveyed through a closely confining tube located between electrodes by which a radio frequency energy field is created in the tube, the packing of the tube with such fibres being sufficiently dense to ensure that, when heated by the energy field, the tube and its contents form a partially self-sealing pressure chamber whereby the rate of reaction of the dye or chemical on the fibres is accelerated. Various embodiments of apparatus for the performance of such a fixation process on fibres of different forms and combinations are also shown.

1 Claim, 6 Drawing Figures

FIXATION OF DYES AND OTHER CHEMICALS IN TEXTILE FIBRES

This invention relates to the fixation of dyes and other chemical in textile fibres by subjecting the treated fibres to radio frequency heat energy of the order of 27.12 Mega Hertz, it having already been proposed to use radio frequency generating apparatus for the heat setting of textile fabrics whilst held stationary between pressure applying elements.

In accordance with the present invention however a process for the fixation of dyes and other chemicals in textile fibres, however formed or combined, comprises continuously conveying fibres which have been wetted with dye or other chemical substance through a closely confining tube located between electrodes by which a radio frequency energy field is created in the tube, the packing of the tube being sufficiently dense as to ensure that when heated by the energy field the tube and its contents form a partially self-sealing pressure chamber whereby the rate of reaction of the dye or chemical on the fibres is accelerated.

The invention also provides apparatus for the performance of the process as above defined comprising a casing containing a pair of opposed radio frequency heating electrodes, a tube made of non-lossy material located between the electrodes and means within the tube for continuously conveying textile fibre through the tube, so as to be heated therein, with the generation of pressure so as to accelerate the rate of reaction of the dye or chemical on the fibres as aforesaid.

The process can be performed on fibres in the forms of loose aggregate, tops, slubbing, tow, yarn and fabrics - whether knitted, woven, needled sprayed and so forth - for instance carpets.

In the drawings there is shown a particular and at present preferred form of dye and fixation unit for use in the performance of the process of the invention as well as arrangemens for the feeding of different fibrous materials thereto.

Figure 1:
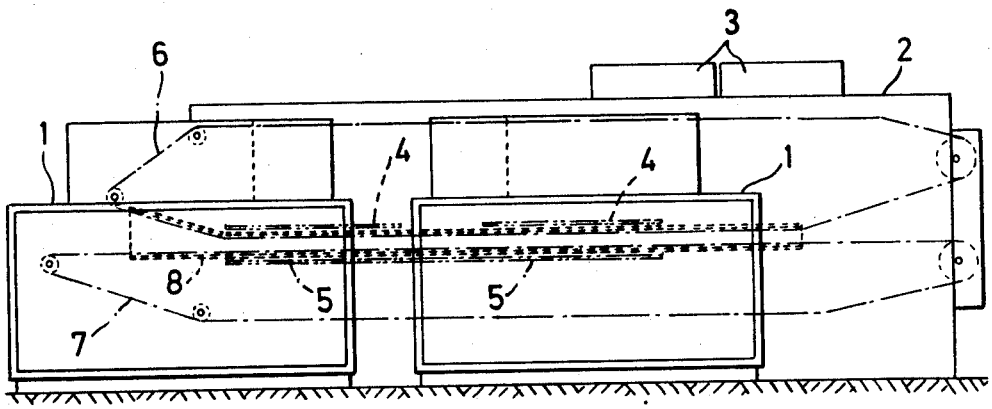
FIG. 1 is a side elevation of dye and chemical fixation unit.
Figure 2:
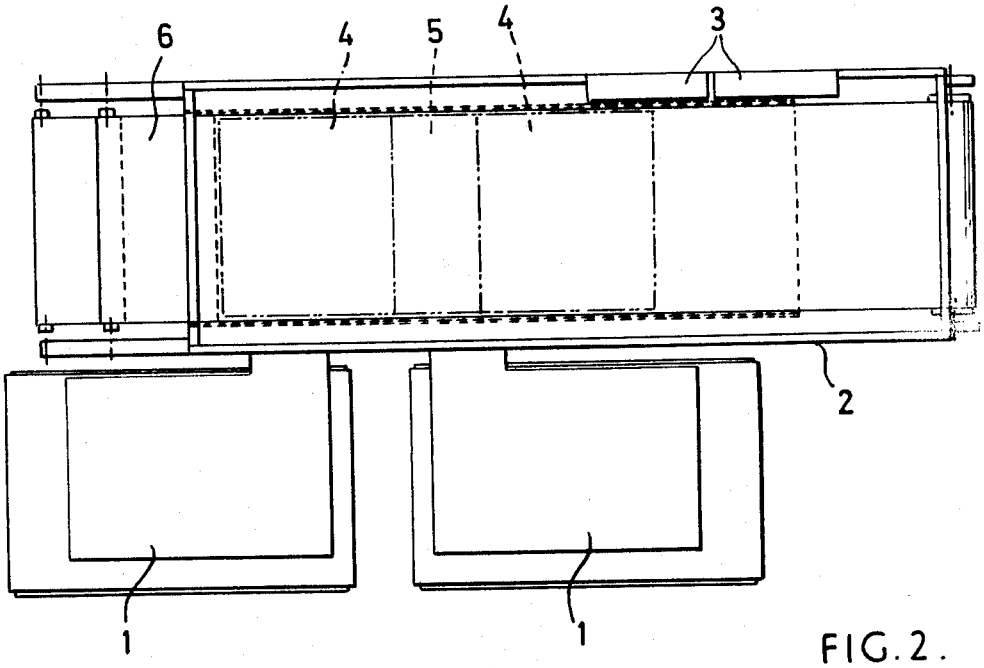
FIG. 2 is a plan view of the unit shown in FIG. 1.

Referring now to FIGS. 1 and 2 the dye and chemical fixation unit therein illustrated, comprises a pair of 15 kilo watt radio frequency (27.12 MHz) generators 1 mounted to one side of a casing 2 having control panels 3 on its other side. The casing 2 contains two pairs of upper and lower flat parallel plate electrodes 4,5 between which there is mounted an elongated flat rectangular cross-section tube 8 4 meters long, 1 meter wide and 0.07 meters in depth made of armoured glass or polypropylene. Also within the casing is a pair of perforated or solid conveyor belts 6,7 which are continuously driven by any suitable driving means (not shown) and which are made of glass fibre coated with polytetrafluoroethylene. The lower run of the upper belt 6 and the upper run of the lower belt 7 are adjacent and parallel and extend within the tube 8 respectively adjacent its upper and lower walls.

As shown in each of FIGS. 3 to 6 inclusive there is located in front of the radio frequency dye and fixation unit, a dye or other chemical transfer unit comprising a tank 9, or series of tanks mounted above the unit containing dye padding material or other chemical with which the textile fibre material is to be wetted. Whatever the dye or chemical it is transferred by means of a belt 10 to the fibre material as the latter is fed to a mangle comprising an upper drum 11 and a lower drum 12 over which the belt 10 passes.

After leaving the drum 11 and belt 10 the fibres are deposited on the upper run of the lower conveyor belt 7 so as to be carried thereby into the tube 8 of the radio frequency dye fixation unit.

The apparatus used for feeding the fibrous material to the dye or chemical transfer unit differs depending on the nature of the material.

Figure 3:
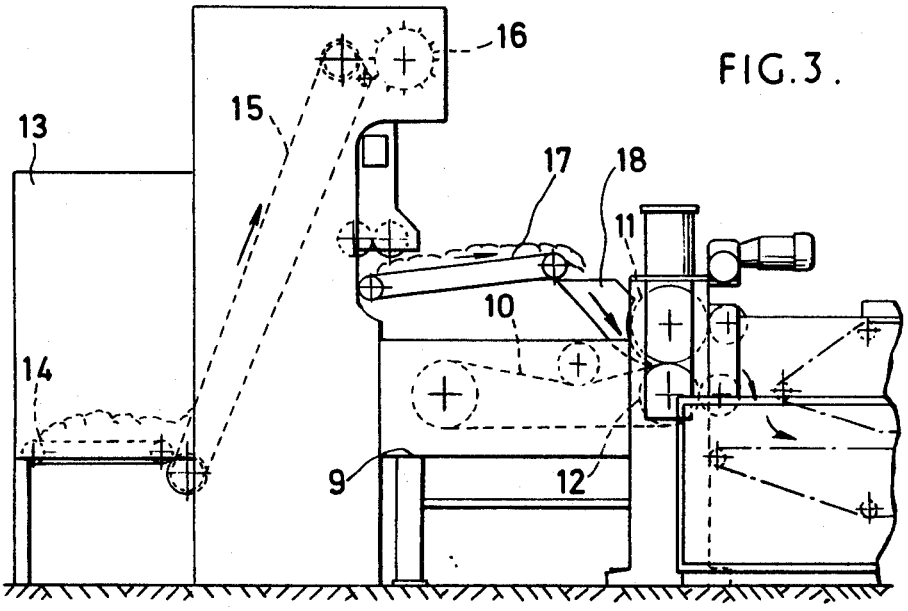
FIGS. 3, 4, 5 and 6 show arrangements respectively for feeding treated loose fibres, tops, yarns, and cloth or carpet to the dye and chemical fixation unit shown in FIGS. 1 and 2.

Thus FIG. 3 shows loose fibres contained in a double volumetric hopper 13 containing a belt conveyor 14 which feeds the loose fibres to an elevator 15. At the top end of the elevator 15 there is a stripping wheel 16 and below the latter there is a feed belt 17 which delivers the fibres to a chute 18 which faces the upper drum 11. It can be arranged that this feed belt should convey the fibres if required through a device which detects and removes metal particles which contaminate the fibres.

Figure 4:
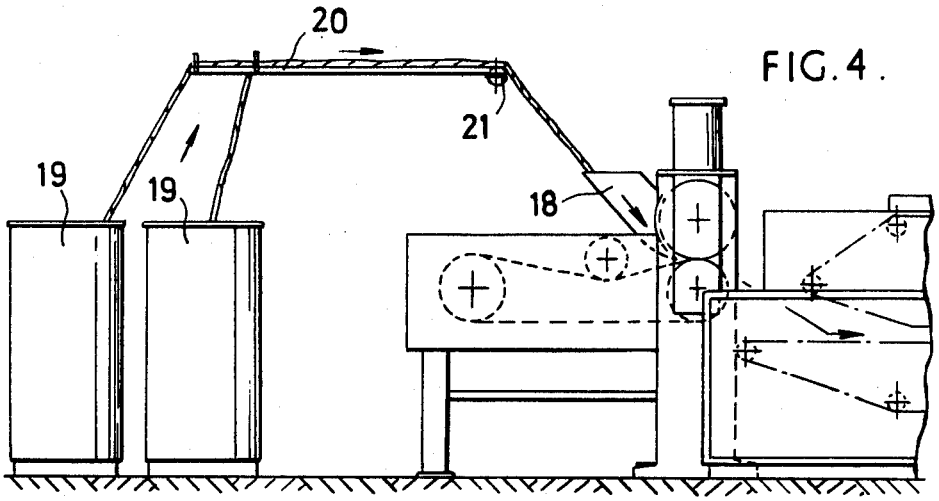

FIG. 4 shows two cans 19 containing tops which are drawn upwardly and over a table 20 and roller 21 before entering the chute 18.

Figure 5:
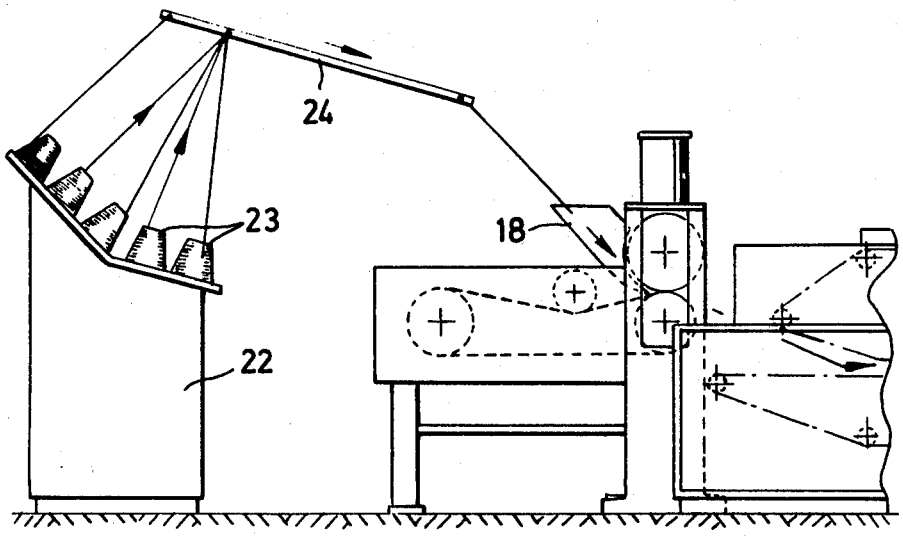

FIG. 5 shows a creel 22 with yarn cones 23 whence the yarns pass upwardly to and along a frame 24 before entering the chute 18.

Figure 6:
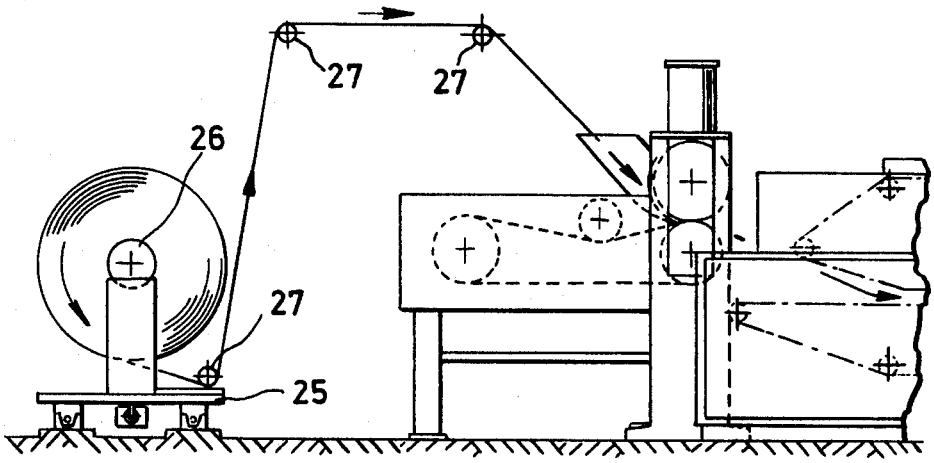

FIG. 6 shows a floating carriage 25 on which is mounted a spool 26 of cloth or carpet. After leaving the spool the cloth is guided by a set of rollers 27 into the chute 18.

In the performance of the process of the invention by use of apparatus as above described, it is necessary to ensure that the wetted fibre material substantially fills the width and depth of the tube 8 so that the steam which is uniformly generated as a result of the R.F. energy transmission develops a pressure because it cannot readily escape from the ends of the tube. There is thus produced, by reason of the sealing effect of the fibres at the tube ends, a heated pressure chamber which accelerates the fixation of the dye or the reaction of some other chemical on the fibre, as the case may be.

Washing off after fixation is only normally required for deep shades. All types of fibre whether animal vegetable or synthetic are susceptible of treatment by the process and apparatus of the invention as hereinbefore described.

I claim:

1. A process for the fixation of dyes and other chemicals in textile fibres, however formed or combined, which comprises continuously mechanically conveying fibres which have been wetted with dye or other chemical substance through a closely confining tube located between electrodes by which a radio frequency energy field is created in the tube, the packing of the tube being sufficiently dense as to ensure that when heated by the energy field the tube and its contents form a partially self sealing pressure chamber due to generation of steam from the wetted fibres whereby the rate of reaction of the dye or chemical on the fibres is accelerated.

* * * * *